US007109961B2

(12) United States Patent
Osame

(10) Patent No.: US 7,109,961 B2
(45) Date of Patent: Sep. 19, 2006

(54) ELECTRIC CIRCUIT, LATCH CIRCUIT, DISPLAY APPARATUS AND ELECTRONIC EQUIPMENT

(75) Inventor: Mitsuaki Osame, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 345 days.

(21) Appl. No.: 10/386,229

(22) Filed: Mar. 11, 2003

(65) Prior Publication Data

US 2003/0210219 A1 Nov. 13, 2003

(30) Foreign Application Priority Data

Mar. 13, 2002 (JP) ..... 2002-067762

(51) Int. Cl.
*G09G 5/00* (2006.01)

(52) U.S. Cl. ..... 345/92; 345/204

(58) Field of Classification Search ..... 345/55, 345/87, 92, 98–100, 204–206, 211, 212; 326/68, 81, 83, 114; 327/384, 333
See application file for complete search history.

(56) References Cited

U.S. PATENT DOCUMENTS

| | | | | | |
|---|---|---|---|---|---|
| 5,136,622 | A | | 8/1992 | Plus | 377/64 |
| 5,883,798 | A | * | 3/1999 | Yamaguchi | 363/73 |
| 5,936,459 | A | * | 8/1999 | Hamamoto | 327/536 |
| 6,057,823 | A | | 5/2000 | Aoki et al. | 345/99 |
| 6,072,345 | A | | 6/2000 | Ooishi | 327/157 |
| 6,114,907 | A | * | 9/2000 | Sakurai | 330/253 |
| 6,232,795 | B1 | | 5/2001 | Takahashi et al. | 326/87 |
| 6,252,426 | B1 | * | 6/2001 | Fulkerson | 326/113 |
| 6,275,210 | B1 | | 8/2001 | Maekawa | 345/98 |
| 6,563,744 | B1 | * | 5/2003 | Kuroki | 365/189.05 |
| 6,593,920 | B1 | * | 7/2003 | Okumura et al. | 345/204 |
| 6,603,453 | B1 | | 8/2003 | Yamazaki et al. | 345/92 |
| 6,759,701 | B1 | * | 7/2004 | Shimizume | 257/297 |
| 2001/0017609 | A1 | * | 8/2001 | Okumura et al. | 345/98 |
| 2001/0040469 | A1 | | 11/2001 | Takahashi et al. | 326/110 |
| 2002/0024362 | A1 | | 2/2002 | Takahaski et al. | 326/110 |
| 2002/0047733 | A1 | * | 4/2002 | Shimizume | 327/100 |
| 2002/0130683 | A1 | * | 9/2002 | Nishio et al. | 326/83 |
| 2003/0012330 | A1 | | 1/2003 | Osame | 377/2 |
| 2004/0004593 | A1 | * | 1/2004 | Okumura et al. | 345/87 |
| 2004/0061542 | A1 | | 4/2004 | Osame et al. | 327/291 |
| 2004/0257117 | A1 | * | 12/2004 | Kimura | 326/122 |

FOREIGN PATENT DOCUMENTS

| | | |
|---|---|---|
| JP | 11-184440 | 7/1999 |
| JP | 2000-339985 | 12/2000 |

OTHER PUBLICATIONS

English Abstract re Japanese Patent Application No. 11–184440 published Jul. 9, 1999.
European Search Report re application No. EP 03021743.4, dated Sep. 29, 2004.

* cited by examiner

*Primary Examiner*—Amare Mengistu
(74) *Attorney, Agent, or Firm*—Cook, Alex, McFarron, Manzo, Cummings & Mehler, Ltd.

(57) ABSTRACT

In order to perform operations securely, a high potential power supply is connected to a gate electrode of a P-type TFT to which data signals are input. Similarly, a low potential power supply is connected to a gate electrode of an N-type TFT. Thus, a TFT to which data signals are input can be turned OFF during a non-operating period. Switch TFT's are provided between the high potential power supply and the P-type TFT and between the low potential power supply and the N-type TFT so as to turn the TFT OFF as required. Similarly, Switch TFT's are provided between a data signal input terminal and a P-type TFT and between a data signal input terminal and an N-type TFT such that a data signal can be input thereto as required. The switching is controlled by using a latch signal and an inverse latch signal. Therefore, a latch circuit without a level shifter can be produced which can operate with stability.

23 Claims, 7 Drawing Sheets

ELECTRIC CIRCUIT, LATCH CIRCUIT, DISPLAY APPARATUS AND ELECTRONIC EQUIPMENT

BACKGROUND OF THE INVENTION

1. Field of the Invention

The present invention relates to a display apparatus for inputting digital video signals and for displaying pictures. The display apparatus includes a liquid crystal display apparatus using liquid crystal elements as pixels and a display apparatus using light-emitting elements such as electroluminescence (EL) elements.

The present invention also relates to an electric circuit and, in particular, to a latch circuit for holding data.

2. Description of the Related Art

Recently, an active matrix type display apparatus is used in many products and is widely spread. The active matrix type display apparatus includes a display apparatus including a semiconductor thin film on an insulator such as a glass substrate and, especially, a liquid crystal display (LCD) using thin film transistors (called TFT, hereinafter). The active matrix type display device has several hundred thousands to several millions of pixels provided on matrix. The brightness of pixels is controlled by TFT's provided in pixels so as to display pictures.

Furthermore, recently, a technology has developed for forming pixels and peripheral circuits integrally on a same substrate by using polysilicon TFT's. This kind of technologies greatly contributes to the reduction in display apparatus size and in power consumption. Recently, the mobile information terminals expand the application field significantly. The display apparatus is required as a display portion of each of the mobile information terminals.

FIG. 2 shows a conventional example (conventional data latch) of a circuit for capturing and holding video data sequentially by using pulses from a shift register. The circuit includes a first clocked inverter 1000, an inverter 1010 and a second clocked inverter 1020. The first clocked inverter 1000 has four TFT's including P-type TFT's 1001 and 1002 and N-type TFT's 1003 and 1004. In FIG. 2, the second clocked inverter 1020 is indicated by a generally used circuit symbol. The construction of the second clocked inverter 1020 is the same as that of the first clocked inverter 1000 shown in FIG. 2. A latch signal (LAT) is input to a gate electrode of the P-type TFT 1001. A high potential power supply (VDD) is connected to a source electrode of the P-type TFT 1001. A source electrode of the P-type TFT 1002 is connected to a drain electrode of the P-type TFT 1001. A data signal (DATA) is input to a gate electrode of the P-type TFT 1002. An output terminal (OUTPUT) of the first clocked inverter 1000 is connected to the drain electrode of the P-type TFT 1002.

On the other hand, an inverse latch signal (LATB) is input to a gate electrode of the N-type TFT 1004. A low potential power supply (VSS) is connected to a source electrode of the N-type TFT 1004. One of a source electrode and drain electrode of the N-type TFT 1003 is connected to a drain electrode of the N-type TFT 1004 on the other hand. A data signal (DATA) is input to a gate electrode of the N-type TFT 1003. An output terminal (OUTPUT) of the first clocked inverter 1000 is connected to a drain electrode of the N-type TFT 1003.

An input terminal of the inverter 1010 is connected to an output terminal (OUTPUT) of the first clocked inverter 1000. An input terminal of the second clocked inverter 1020 is connected to an output terminal of the inverter 1010. An output terminal (OUTPUT) of the first clocked inverter 1000 is connected to an output terminal of the second clocked inverter 1020. A latch signal and the inverse signal (not shown) are connected to the second clocked inverter.

Details of an operation of the circuit shown in FIG. 2 will be described. A digital circuit is used herein. Therefore, input and output potentials are expressed in binary of HIGH and LOW, respectively. Signal potentials of a data signal (DATA), a latch signal (LAT) and an inverse latch signal (LATB) to be input to the circuit are usually the same as the power supply potential of the circuit (HIGH and LOW potentials of input and output potentials are VDD and VSS, respectively). However, the HIGH/LOW potentials do not have to be always the same as the power supply potential (VDD/VSS). The HIGH/LOW potentials may be the same as the power supply potential (VDD/VSS) when they are dealt in binary. For example, the HIGH potential includes a potential lower than VDD and is reduced by the N-type transistor by a threshold value. Potentials, which can return to VDD/VSS by using an amplitude compensating circuit or the like, can be the same HIGH/LOW potential.

An operation will be described where a latch signal (LAT) is LOW while an inverse latch signal (LATB) is HIGH. Here, the P-type TFT 1001 and the N-type TFT 1004 are turned ON. Therefore, VDD is output from the drain electrode of the P-type TFT 1001. VSS is output from the drain electrode of the N-type TFT 1004.

A Data signal (DATA) is input to the gate electrodes of the P-type TFT 1002 and the N-type TFT 1003. Here, when an input potential of the data signal (DATA) is HIGH, the N-type TFT 1003 of the P-type TFT 1002 and the N-type TFT 1003 is turned ON. Therefore, VSS is output to the output terminal (OUTPUT).

On the other hand, when an input potential of the data signal (DATA) is LOW, the P-type TFT 1002 of the P-type TFT 1002 and the N-type TFT 1003 is turned ON. Therefore, VDD is output to the output terminal (OUTPUT).

Here, when a latch signal (LAT) is LOW and an inverse latch signal (LATB) is HIGH, the second clocked inverter 1020 is in a high-impedance state. Therefore, the output of the second clocked inverter 1020 does not conflict with the output of the first clocked inverter 1000.

Next, an operation will be described when a latch signal (LAT) is HIGH and an inverse latch signal (LATB) is LOW. Here, the P-type TFT 1001 and the N-type TFT 1004 are turned OFF. Then, the first clocked inverter 1000 enters into the high-impedance state. The second clocked inverter 1020 functions as an inverter and establishes a loop together with the inverter 1010. Thus, a video signal is captured and is held when a latch signal (LAT) is LOW.

A power supply potential of a TFT circuit needs to be generally about 10 V. On the other hand, a controller IC for generating a data signal outside of the panel operates at a power supply potential lower than that of the TFT circuit. Therefore, the controller IC generally generates signals at a voltage of 3.3 V. When a signal is generated at the low voltage and is input to the TFT circuit as shown in FIG. 2, a level-shift circuit outside or inside of the panel raises the voltage to about 10 V. Then, the signal at 10 V is input to the circuit in FIG. 2. When the voltage is level-shifted outside of the panel, the number of parts of the level-shift IC, the power supply IC and the like are increased. Furthermore, the power consumption is increased. When the voltage is level-shifted inside of the panel, the size of the layout area, power consumption and difficulty in high frequency operation are increased disadvantageously.

The signal at 3.3 V may be directly input to the circuit in FIG. 2 without being level-shifted. However, problems may occur as described below.

For example, the circuit in FIG. 2 may operate at VSS of 0V, VDD of 9V, and LOW and HIGH potentials of data signals (DATA) of 3V and 6V, respectively. Also, HIGH and LOW potentials of the latch signal (LAT) and the inverse latch signal (LATB) are 9V and 0V, respectively. In this case, the HIGH potential is the same as the power supply potential. The threshold values of all of the N-type TFT's are 2V. The threshold values of the P-type TFT's are −2V.

Here, when the latch signal (LAT) is the LOW potential and the inverse latch signal (LATB) is the HIGH potential, the P-type TFT 1001 and the N-type TFT 1004 are completely turned ON. The potential of one of the source electrode and the drain electrode of the P-type TFT 1001 is 9V. The potential of one of the source electrode and drain electrode of the N-type TFT 1004 is 0V. Here, when a data signal (DATA) at the HIGH potential (6V) is input, the N-type TFT 1003 is turned ON. Because the input voltage is low, the P-type TFT 1002 does not enter into the OFF region operation and is therefore turned ON. However, differences between the gate-source voltages of the P-type TFT 1002 and the N-type TFT 1003 and the threshold value are −1V and 4V, respectively. Generally, a current ability of the P-type TFT and a current ability of the N-type TFT are calculated from the mobility and the size of the TFT's. Therefore, the current abilities of the P-type TFT and N-type TFT are designed substantially equal. In this case, the N-type TFT 1003 has a larger absolute value of the difference between the gate-source voltage and the threshold value. Therefore, the N-type TFT 1003 has lower effective resistance than that of the P-type TFT 1002. As a result, a value near 0V is expected from the output terminal (OUTPUT). In this case, a proper operation may be performed logically. However, the P-type TFT 1002 is expected to turn OFF but is turned ON. Therefore, flow-through current flows between the power supplies VDD to VSS. As a result, the current consumption is increased disadvantageously.

The proper operation may not be performed disadvantageously in a following case. For example, a threshold value of the N-type TFT is 5 V and a threshold value of the P-type TFT is −1 V. The latch signal (LAT) is at LOW potential while the inverse latch signal (LATB) is at HIGH potential. In this case, as described-above, the P-type TFT 1001 and the N-type TFT 1004 are completely turned ON. The potential of the output electrode of the P-type TFT 1001 is 9V. The potential of the output electrode of the N-type TFT 1004 is 0V. When a data signal (DATA) at the HIGH potential (6V) is input, the difference between the gate-source voltage of the P-type TFT 1002 and the threshold value is −2V. The difference between the gate-source voltage of the N-type TFT 1003 and the threshold value is 1V. When $\beta_P=\beta_N$, the P-type TFT 1002 has a large absolute value for the difference between the gate-source voltage and the threshold value. Therefore, the P-type TFT 1002 has effectively lower resistance than that of the N-type TFT 1003. As a result, VDD is output from the output for the HIGH data input. Therefore, the proper operation may not be performed.

The threshold values of TFT's may vary in accordance with the process of producing the TFT's. Therefore, when a signal at a lower voltage than the power supply potential is directly input to the circuit in FIG. 2, the threshold values of the opposing P-type TFT 1002 and N-type TFT 1003 may be largely different from a predetermined value. In this case, the operation may not be performed properly.

SUMMARY OF THE INVENTION

The invention was made in view of the problems. It is an object of the invention to provide a circuit in a semiconductor apparatus including TFT'S, which can operate with low power consumption at high frequencies and which is strong against differences in TFT characteristics.

In order to overcome the above-described problems, according to the present invention, a TFT and a data reading circuit are used. The TFT inputs a power supply potential to each of a P-type TFT and N-type TFT for determining HIGH and LOW of a data signal (DATA) at an initial state. The data reading circuit has TFT's having the opposite polarities to those of the P-type TFT and N-type TFT. The data reading circuit inputs a data signal (DATA) to gate electrodes of the P-type TFT and N-type TFT in a period for capturing signal data (DATA). By using the TFT and the data reading circuit, a potential of the data signal (DATA) is input to one of the gate electrodes of the P-type TFT and N-type TFT so as to turn ON. A potential, which can more easily turn ON, is input to the other gate electrode.

Conventionally, a data signal (DATA) is directly input to the gate electrodes of the P-type TFT and N-type TFT. On the other hand, the reading circuit according to the invention differentiates potentials to be input to the gate electrodes of the P-type TFT and N-type TFT for the accurate operation. Thus, the operational margin can be improved. Therefore, the data reading circuit can be provided which is strong against the differences in transistor characteristics and which can operate with low power consumption at high frequencies.

A schematic diagram of the construction is shown in FIG. 11. FIG. 11 includes three circuits and three signal input portions.

The operation will be described. A first circuit 2001 selects a third signal or a first power supply based on a first signal and inputs to a third circuit 2003. A second circuit 2002 selects a third signal or a second power supply based on a second signal and inputs to a third circuit 2003. When the first circuit 2001 and the second circuit 2002 select the third signal, the output of the third circuit 2003 is an output signal in accordance with the third signal. The output signal is at a potential of the second power supply when the third signal is at the HIGH potential. The output signal is at a potential of the first power supply when the third signal is at the LOW potential. When the first circuit 2001 selects a power supply 1 and when the second circuit 2002 selects a power supply 2, the third circuit 2003 has the high impedance.

Here, the existence of the first circuit 2001 and the second circuit 2002 can compensate the output of the third circuit 2003. Therefore, the first circuit 2001 and the second circuit 2002 are called first compensating circuit and second compensating circuit, respectively.

According to an aspect of the invention, an electric circuit comprises an N-type transistor, a first P-type transistor, and a second P-type transistor, the N-type transistor and the first P-type transistor are connected in series, a gate electrode of the N-type transistor is connected to a gate electrode of the first P-type transistor, a drain electrode of the N-type transistor and a drain electrode of the first P-type transistor are connected to a gate electrode of the second P-type transistor, a source electrode of the first P-type transistor is connected to a power supply electrically, and signals are input to a source electrode of the N-type transistor.

In the electric circuit, the N-type transistor may be replaced by an analog switch.

According to another aspect of the invention, an electric circuit comprises a first N-type transistor, a P-type transistor, and a second N-type transistor, the first N-type transistor and the P-type transistor are connected in series, a gate electrode of the first N-type transistor is connected to a gate electrode of the P-type transistor, a drain electrode of the first N-type transistor and a drain electrode of the P-type transistor are connected to a gate electrode of the second N-type transistor, a source electrode of the first N-type transistor is electrically connected to a power supply, and signals are input to a source electrode of the P-type transistor.

In this construction of the present invention, the P-type transistor may be replaced by an analog switch.

In this construction of the present invention, further, the amplitude of the signals may be smaller than that of power supply voltage.

According to another aspect of the present invention, there is provided a latch circuit using the electric circuit having the above construction.

According to another aspect of the invention, a latch circuit comprises a first N-type transistor and first P-type transistor connected in series, a first compensating circuit for selecting an input of a data signal or an input of a first power-supply potential based on an input latch signal and for outputting the selected input to a gate electrode of the first P-type transistor, a second compensating circuit for selecting an input of a data signal or an input of a second power-supply potential based on an input inverse latch signal and for outputting the selected input to a gate electrode of the first N-type transistor. The data signal is input from a same signal line, the output of the latch circuit is extracted from a connecting portion between the first N-type transistor and the first P-type transistor.

According to another aspect of the invention, a latch circuit comprises a circuit having a first P-type transistor and a first N-type transistor, a first compensating circuit having a second N-type transistor and a second P-type transistor, a second compensating circuit having a third N-type transistor and a third P-type transistor. A source electrode of the first P-type transistor is connected to a first power supply, and a source electrode of the first N-type transistor is connected to the second power supply. Gate electrodes of the second N-type transistor and second P-type transistor are connected to each other, and the second N-type transistor and the second P-type transistor are connected in series. Gate electrodes of the third N-type transistor and third P-type transistor are connected to each other, and the third N-type transistor and third P-type transistor are connected in series. Source electrodes of the second N-type transistor and third P-type transistor are connected to a same data line, a source electrode of the second P-type transistor is connected to the first power supply, and a source electrode of the third N-type transistor is connected to the second power supply. Drain electrodes of the second N-type transistor and second P-type transistor are connected to a gate electrode of the first P-type transistor, and drain electrodes of the third N-type transistor and third P-type transistor are connected to a gate electrode of the first N-type transistor. An output is extracted from a drain electrode of the first N-type transistor or first P-type transistor.

In this construction, a level shifter is not required. Therefore, a circuit can be provided which can operate with low power consumption at high frequencies and which is strong against differences in TFT characteristic.

DESCRIPTION OF THE PREFERRED EMBODIMENTS

Figure 2:
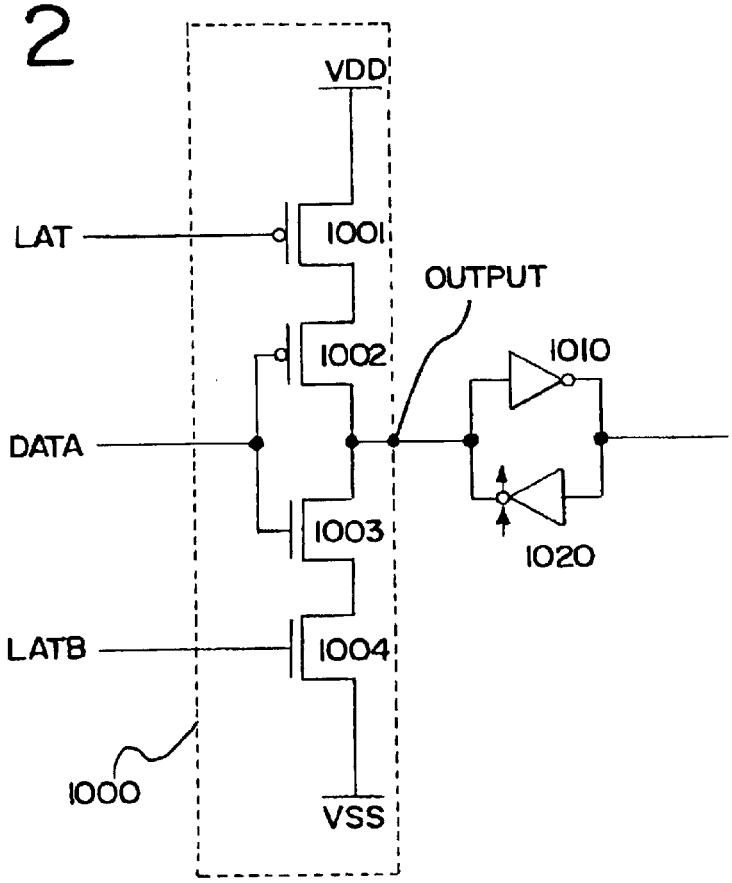
FIG. 2 is a diagram of a latch circuit in a conventional example.

Embodiments of the invention will be described below with reference to drawings. Here, unless otherwise indicated, VDD is 9V and VSS is 0V. High potential of a data signal is 6V. Low potential is 3V. HIGH potential of a latch signal is 9V. LOW potential is 0V. HIGH potential of an output is 9V. LOW potential is 0V. Apparently, these potentials are not limited to these values in an actual circuit. For convenience in description, the circuit according to the invention is called data reading circuit below. The data reading circuit corresponds to a first clocked inverter 1000 in the conventional example shown in FIG. 2. The TFT herein may have a single gate, double gate or multi-gate construction. The TFT may have any publicly known construction.

First Embodiment

Figure 1:
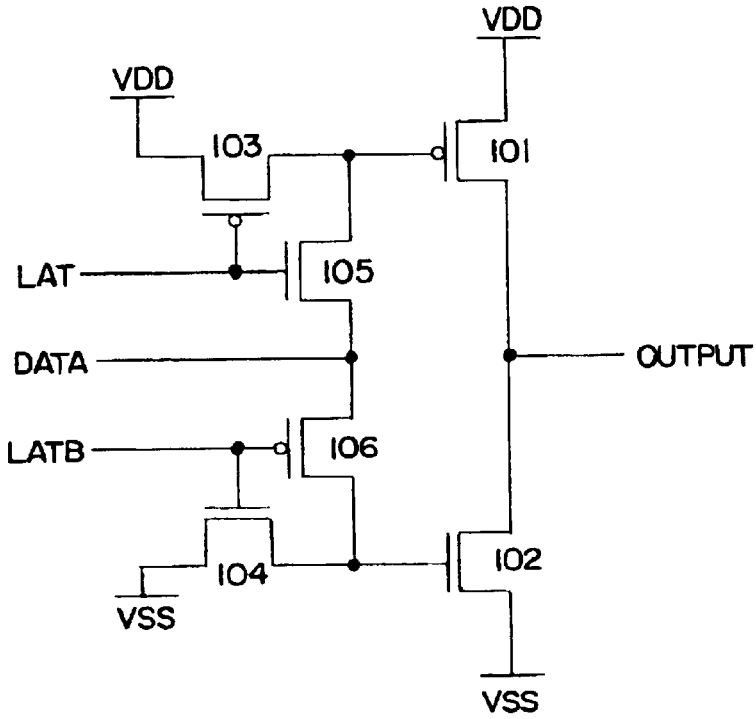
FIG. 1 is a diagram showing an embodiment of the invention.

FIG. 1 shows a construction of a data reading circuit according to this embodiment. The data reading circuit according to this embodiment has six transistors including first, second and third P-type TFT's 101, 103 and 106 and first, second and third N-type TFT's 102, 104 and 105. One of a drain electrode of the second P-type TFT 103, a source electrode of the third N-type TFT 105 and a source electrode and drain electrode of the third N-type TFT 105 is connected to a gate electrode of the first P-type TFT 101. A high potential power supply (VDD) is connected to a source electrode of the first P-type TFT 101. One of a drain electrode of the second N-type TFT 104 and a source electrode or drain electrode of the third P-type TFT 106 is connected to a gate electrode of the first N-type TFT 102. A low potential power supply (VSS) is connected to a source electrode of the first N-type TFT 102.

A latch signal (LAT) is input to the gate electrode of the second P-type TFT 103 and the gate electrode of the third N-type TFT 105. The high potential power supply (VDD) is connected to the source electrode of the second P-type TFT 103. An inverse signal (LATB) is input to the gate electrode of the second N-type TFT 104 and the gate electrode of the third P-type TFT 106. The low potential power supply (VSS) is connected to the source electrode of the second N-type TFT 104. A data signal (DATA) is input to the other of the source electrode and drain electrode of the third N-type TFT 105 and the other of the source electrode and drain electrode of the third P-type TFT 106.

An output terminal (OUTPUT) is connected to the drain electrode of the first P-type TFT 101 and the drain electrode of the first N-type TFT 102.

Figure 3A:
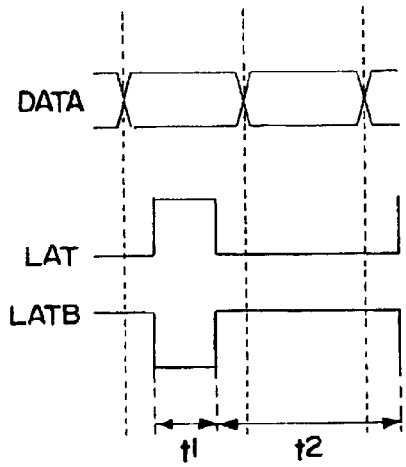
FIGS. 3A to 3E are diagrams each showing a timing chart for a latch circuit operation.

Next, the operation will be described. Inputs of a data signal (DATA), a latch signal (LAT) and an inverse latch signal (LATB) are performed in accordance with a timing chart as shown in FIG. 3A. Here, in a period t1, the latch signal (LAT) is HIGH and the inverse latch signal (LATB) is LOW. In a period t2, the latch signal (LAT) is LOW and the inverse latch signal (LATB) is HIGH. The data signal (DATA) may be either HIGH or LOW (the data signal does not change in the period t1 herein). Operations in these periods will be described below.

In the period t1, the latch signal (LAT) at HIGH potential and the inverse latch signal (LATB) at LOW potential turn OFF the second P-type TFT 103 and the second N-type TFT 104. Here, the data signal (DATA) at HIGH potential turns ON the third P-type TFT 106 and the first N-type TFT 102. When an absolute value of a threshold value of at least one of the third N-type TFT 105 and first P-type TFT 101 is larger than 3V, the first P-type TFT 101 is turned OFF. As a result, the output (OUTPUT) becomes VSS potential.

On the other hand, the data signal (DATA) at LOW potential turns ON the third N-type TFT 105 and the first P-type TFT 101. When an absolute value of a threshold value of at least one of the third P-type TFT 106 and the first N-type TFT 102 is larger than 3V, the first N-type TFT 102 is turned OFF. As a result, the output (OUTPUT) becomes VDD potential. Therefore, power consumption can be reduced without leak current.

An operation will be described below for a case where the absolute value of the threshold value is not larger than 3V (for example, when the threshold value of the P-type TFT is −2V and when the threshold value of the N-type TFT is 2V).

When a data signal (DATA) is HIGH, the third P-type TFT 106 and the first N-type TFT 102 are turned ON. The third N-type TFT 105 and the first P-type TFT 101 are also turned ON without entering into the OFF region operation. A difference between the gate-source voltage of the first P-type TFT 101 and the threshold value is −1V. A difference between the gate-source voltage of the first N-type TFT 102 and the threshold value is 4V. Generally, a current ability of a TFT can be calculated from the mobility and size of the TFT. In this case, the current ability of the P-type TFT and the current ability of the N-type TFT are designed so as to be substantially equal. Therefore, the N-type TFT 102 has a larger absolute value of the difference between the gate-source voltage and the threshold value. Thus, the effective resistance of the N-type TFT 102 is lower than that of the P-type TFT 101. As a result, LOW potential is output from the output terminal (OUTPUT).

On the other hand, when a data signal (DATA) is LOW, the third N-type TFT 105 and the first P-type TFT 101 are turned ON. The third P-type TFT 106 and the first N-type TFT 102 are also turned ON without entering into the OFF region operation. A difference between the gate-source voltage of the first P-type TFT 101 and the threshold value is −4V. A difference between the gate-source voltage of the first N-type TFT 102 and the threshold value is 1V. Therefore, the effective resistance of the first P-type TFT 101 is lower than that of the first N-type TFT 102. As a result, HIGH potential is output from the output terminal (OUTPUT).

In the period t2, a latch signal (LAT) at the LOW potential turns OFF the third N-type TFT 105 and turns ON the second P-type TFT 103. The potential of the gate electrode of the first P-type TFT 101 becomes VDD. Then, the first P-type TFT 101 is turned OFF. At the same time, an inverse latch signal (LATB) at HIGH potential turns OFF the third P-type TFT 106 and turns ON the second N-type TFT 104. The potential of the gate electrode of the first N-type TFT 102 becomes VSS. The first N-type TFT 102 is also turned OFF. Then, the data reading circuit enters into the high-impedance state. Therefore, even when a data signal (DATA) changes during the period t2, the change does not affect on the output of the output terminal (OUTPUT).

The data reading circuit according to the present invention is different from the conventional example in two points as follows.

First of all, the data reading operation can operate with a threshold value, which is not valid for the conventional technologies. For example, in FIG. 1, a threshold value of the N-type TFT is 5V and a threshold value of a P-type TFT is −1V. As described above, the conventional technologies do not operate normally with these threshold values. Here, a data capturing operation will be considered when a latch signal (LAT) is HIGH and an inverse latch signal (LATB) is LOW. A latch signal (LAT) at HIGH potential turns OFF the second P-type TFT 103. Similarly, an inverse latch signal (LATB) at the LOW potential turns OFF the second N-type TFT 104. In the initial state, a potential applied to the gate electrode of the first P-type TFT 101 is VDD (9 V). A potential applied to the gate electrode of the first N-type TFT 102 is VSS (0V).

When a data signal (DATA) is at HIGH potential (6 V), a threshold value of the third N-type TFT 105 is 5 V. Therefore, an absolute value of the gate-source voltage of the third N-type TFT 105 is lower than an absolute value of the threshold value of the N-type TFT 105. As a result, the third N-type TFT 105 is turned OFF. On the other hand, a threshold value of the third P-type TFT 106 is −1 V. The absolute value of the gate-source voltage of the third P-type TFT 106 is higher than the absolute value of the threshold value of the third P-type TFT 106. Thus, the third P-type TFT 106 is turned ON. Therefore, the potential applied to the gate electrode of the first N-type TFT 102 becomes a HIGH data signal (DATA). As a result, the HIGH data signal (DATA) turns the first N-type TFT 102 ON. On the other hand, a potential applied to the gate electrode of the first P-type TFT 101 is 9 V. Still, the first P-type TFT 101 is OFF. Therefore, the LOW potential is output from the output terminal (OUTPUT).

Next, when a data signal (DATA) is at the LOW potential (3 V), the third N-type TFT 105 is turned ON. Then, the potential of the gate electrode of the first P-type TFT 101 agrees with the potential of the data signal (DATA). The third P-type TFT 106 is turned ON. Then, the potential of the gate electrode of the first N-type TFT 102 agrees with the data signal (DATA). Here, a threshold value of the first N-type TFT 102 is 5 V. Therefore, the absolute value of the gate-source voltage of the first N-type TFT 102 is lower than the absolute value of the threshold value. Then, the first N-type TFT 102 is turned OFF. On the other hand, the first P-type TFT 101 is turned ON. As a result, HIGH potential is output from the output terminal (OUTPUT).

In this way, according to the invention, the operation is possible with a threshold value, which is not valid for the conventional technologies.

Furthermore, according to the invention, the response speed is improved. In FIG. 1, a threshold value of the N-type TFT is 2 V. A threshold value of the P-type TFT is −2 V. Here, for example, a LOW data signal (DATA), HIGH latch signal (LAT) and LOW inverse latch signal (LATB) are input. In this case, the latch signal (LAT) at the HIGH potential turns OFF the second P-type TFT 103. Similarly, the inverse latch signal (LATB) at LOW potential turns OFF the second N-type TFT 104.

The data signal (DATA) at LOW potential is input to the input electrode of the third N-type TFT 105 and to the input electrode of the third P-type TFT 106. The latch signal (LAT) at HIGH potential turns ON the third N-type TFT 105. The inverse latch signal (LATB) at LOW potential turns ON the third P-type TFT 106.

Here, the second P-type TFT 103 is turned ON by the latch signal (LAT) at LOW potential immediately before the third, N-type TFT 105 is turned ON. Therefore, the potential of the output electrode of the third N-type TFT 105 is VDD. The potentials of the output electrode and the gate electrode of the third N-type TFT 105 are equal. The operation is saturated. The difference between the gate-source voltage of the third N-type TFT 105 and the threshold value of the third N-type TFT 105 is 4 V.

On the other hand, the second N-type TFT 104 is turned ON by the inverse latch signal (LATB) at HIGH potential immediately before the third P-type TFT 106 is turned ON. Therefore, the potential of the output electrode of the third P-type TFT 106 is VSS. As a result, the difference between the gate-source voltage of the third P-type TFT 106 and the threshold of the third P-type TFT 106 is −1 V.

Generally, a current ability of the P-type TFT and a current ability of the N-type TFT are calculated from the mobility and the size of the TFT's. The current abilities of the P-type TFT and N-type TFT are designed substantially equal. Therefore, the third N-type TFT 105 has a larger absolute value of the difference between the gate-source voltage and the threshold value. Therefore, the third N-type TFT 105 has lower effective resistance than that of the third P-type TFT 106. Thus, the data signal is (DATA) at LOW potential is conducted to the gate electrode of the first P-type TFT 101 earlier than the first N-type TFT 102.

As a result, the first P-type TFT 101 is turned ON earlier than the first N-type TFT 102. Therefore, the HIGH potential can be output faster. When the input data signal (DATA) is HIGH, the first N-type TFT 102 is turned ON earlier according to the same principle. Therefore, LOW potential can be output faster.

In order to use these advantages, no changes in data signals (DATA) are operationally preferable during the period t1.

Second Embodiment

Figure 4:
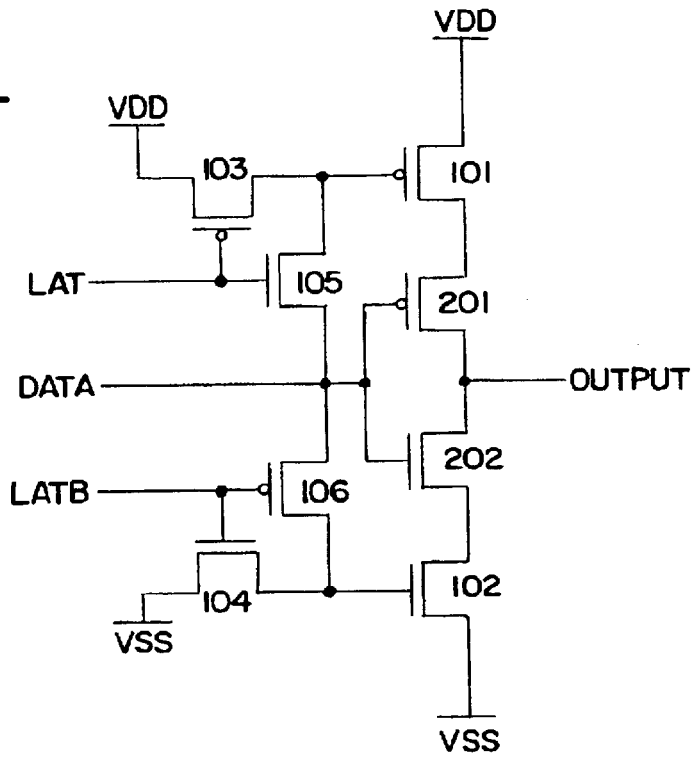
FIG. 4 is a diagram showing an embodiment of the invention.

FIG. 4 shows a construction example of a data reading circuit according to a second embodiment. The data reading circuit according to this embodiment is different from the first embodiment in that a fourth P-type TFT 201 and a fourth N-type TFT 202 are added to the data reading circuit according to the first embodiment. The drain electrode of the first P-type TFT 101 is connected to a source electrode of the fourth P-type TFT 201. The drain electrode of the first N-type TFT 102 is connected to a source electrode of the fourth N-type TFT 202. An output terminal (OUTPUT) is connected to a drain electrode of the fourth P-type TFT 201 and to a drain electrode of the fourth N-type TFT 202. A data signal (DATA) is input to a gate electrode of the fourth P-type TFT 201 and to a gate electrode of the fourth N-type TFT 202.

Next, the operation will be described. A-data signal (DATA), a latch signal (LAT) and an inverse latch signal (LATB) are input in accordance with the timing chart shown in FIG. 3A. In a period t1, the latch signal (LAT) is HIGH and the inverse latch signal (LATB) is LOW. In a period t2, the latch signal (LAT) is LOW and the inverse latch signal (LATB) is HIGH. The data signal (DATA) may be either HIGH or LOW (where the data signal does not change during the period t1). The operations in these periods are performed as follows.

In the period t1,the latch signal (LAT) at HIGH potential and the inverse latch signal (LATB) at LOW potential turn OFF the second P-type TFT 103 and the second N-type TFT 104. Here, the data signal (DATA) at HIGH potential turns ON the third P-type TFT 106, the first N-type TFT 102 and the fourth N-type TFT 202. When an absolute value of a threshold value of at least one of the third N-type TFT 105, first P-type TFT 101 and the fourth P-type TFT 201 is larger than 3 V, the output (OUTPUT) is not VDD. The output (OUTPUT) becomes VSS potential.

On the other hand, the data signal (DATA) at LOW potential turns ON the third N-type TFT 105, the first P-type TFT 101 and the fourth P-type TFT 201. When an absolute value of a threshold value of at least one of the third P-type TFT 106, the first N-type TFT 102 and the fourth N-type TFT 202 is larger than 3V, the output (OUTPUT) is not VSS. The output (OUTPUT) becomes VDD potential. Therefore, power consumption can be reduced without leak current.

An operation will be described below for a case where the absolute value of the threshold value is not larger than 3V (for example, when the threshold value of the P-type TFT is −2V and when the threshold value of the N-type TFT is 2V).

When a data signal (DATA) is HIGH, the third P-type TFT 106, the first N-type TFT 102 and the fourth N-type TFT 202 are turned ON. The third N-type TFT 105, the first P-type TFT 101 and the fourth P-type TFT 201 are also turned ON without entering into the OFF region operation. A difference between the gate-source voltage of the first P-type TFT 101 and the threshold value is −1 V. A difference between the gate-source voltage of the first N-type TFT 102 and the threshold value is 4V. Generally, a current ability of a TFT can be calculated from the mobility and size of the TFT. In this case, the current ability of the P-type TFT and the current ability of the N-type TFT are designed so as to be substantially equal. Here, the first N-type TFT 102 and the fourth N-type TFT 202 have larger absolute values of the differences between the gate-source voltages and the threshold value. Therefore, the effective resistance of the first N-type TFT 102 and the fourth N-type TFT 202 is lower than that of the first P-type TFT 101 and the fourth P-type TFT 201. As a result, the LOW potential is output from the output terminal (OUTPUT).

On the other hand, when a data signal (DATA) is LOW, the third N-type TFT 105, the first P-type TFT 101 and the fourth P-type TFT 201 are turned ON. The third P-type TFT 106, the first N-type TFT 102 and the fourth N-type TFT 202 are also turned ON without entering into the OFF region operation. However, a difference between the gate-source voltage of the first P-type TFT 101 and the threshold value is −4 V. A difference between the gate-source voltage of the first N-type TFT 102 and the threshold value is 1 V. Here, the first P-type TFT 101 and fourth P-type TFT 201 have a large absolute value of the difference between the gate-source voltage and the threshold value. Therefore, the effective resistance of the first P-type TFT 101 and fourth P-type TFT 201 is lower than that of the first N-type TFT 102 and fourth N-type TFT 202. As a result, the HIGH potential is output from the output terminal (OUTPUT).

In the period t2, a latch signal (LAT) at the LOW potential turns OFF the third N-type TFT 105 and turns ON the second P-type TFT 103. The potential of the gate electrode of the first P-type TFT 101 becomes VDD. Then, the first P-type TFT 101 is turned OFF. At the same time, an inverse latch signal (LATB) at HIGH potential turns OFF the third P-type TFT 106 and turns ON the first N-type TFT 104. The potential of the gate electrode of the first N-type TFT 102 becomes VSS. The first N-type TFT 102 is also turned OFF. Then, the data reading circuit enters into the high-impedance state. Therefore, even when a data signal (DATA) changes during the period t2, the change does not affect on the output of the output terminal (OUTPUT).

According to this embodiment, a TFT can operate with a threshold value, which is not valid in the conventional technologies like the first embodiment. Furthermore, the response speed is improved. By increasing the number of TFT's, the resistance ratio of the N-type TFT and P-type TFT is increased. Thus, TFT's can operate more easily and securely. Like the first embodiment, no changes in data signal (DATA) is operationally preferable during the period t1in this embodiment.

Third Embodiment

Figure 5:
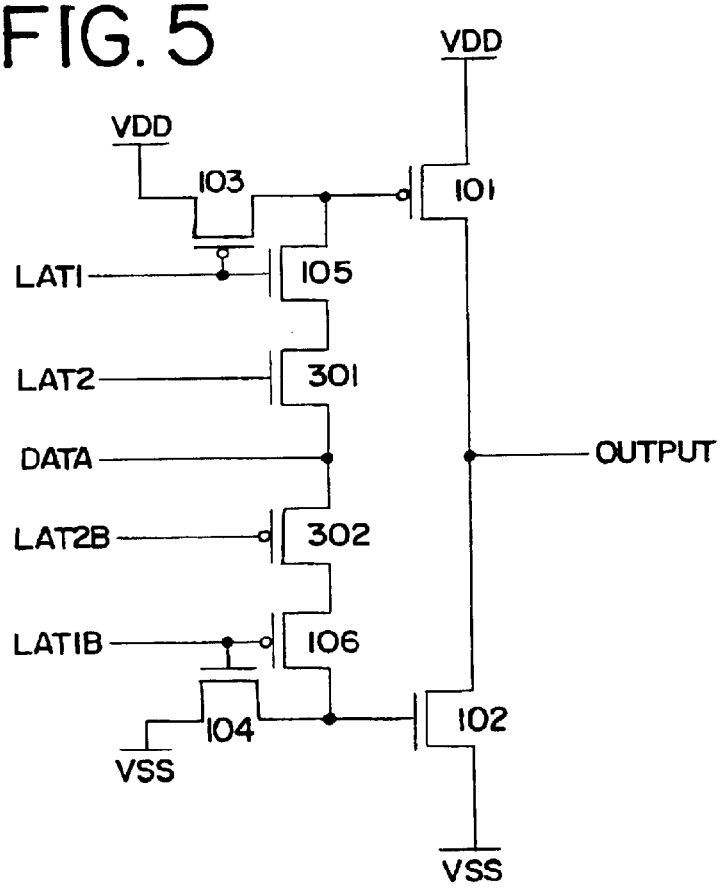
FIG. 5 is a diagram showing an embodiment of the invention.

FIG. 5 shows a construction example of a data reading circuit according to a third embodiment. The data reading circuit according to this embodiment is different from the first and second embodiments in that a fourth N-type TFT 301 and a fourth P-type TFT 302 are added to the data reading circuit according to the first embodiment. The latch signal (LAT) and the inverse latch signal (LATB) in the first embodiment are a first latch signal (LAT1) and a first inverse latch signal (LAT1B) in this embodiment. A second latch signal (LAT2) and a second inverse latch signal (LAT2B) are newly added.

A data signal (DATA) is input to one of the source electrode and drain electrode of the fourth N-type TFT 301. One of the source electrode and drain electrode of the third N-type TFT 105 is connected to the other. A data input signal (DATA) is input to one of the source electrode and drain electrode of the fourth P-type TFT 302. One of the source electrode and drain electrode of the third P-type TFT 106 is connected to the other.

The first latch signal (LAT1) is input to the gate electrodes of the second P-type TFT 103 and the third N-type TFT 105. The first inverse latch signal (LAT1B) is input to the gate electrodes of the second N-type TFT 104 and the third P-type TFT 106. The first inverse latch signal (LAT1B) is an inverse signal of the first latch signal. The second latch signal (LAT2) is input to the gate electrode of the fourth N-type TFT 301. The second inverse latch signal (LAT2B) is input to the gate electrode of the fourth P-type TFT 302. The second inverse latch signal (LAT2B) is an inverse signal of the second latch signal.

Next, the operation will be described. A data signal (DATA), a first latch signal (LAT1), a first inverse latch signal (LAT1B), a second latch signal (LAT2) and a s second inverse latch signal (LAT2B) are input in accordance with the timing chart shown in FIG. 3B. The second latch signal (LAT2) has a different phase from that of the first latch signal in the same period. In a period t1, the first latch signal (LAT1) is LOW. The second latch signal (LAT2) is LOW. The first inverse latch signal (LAT1B) is HIGH. The second inverse latch signal (LAT2B) is HIGH. In a period t2, the first latch signal (LAT1) is HIGH and the second latch signal (LAT2) is LOW. The first inverse latch signal (LAT1B) is LOW and the second inverse latch signal (LAT2B) is HIGH. In a period t3, the first latch signal (LAT1) is HIGH and the second latch signal (LAT2) is HIGH. The first inverse latch signal (LAT1B) is LOW and the second inverse latch signal (LAT2B) is LOW. In a period t4 , the first latch signal (LAT1) is LOW and the second latch signal (LAT2) is HIGH. The first inverse latch signal (LAT1B) is HIGH and the second inverse latch signal (LAT2B) is LOW. The data signal (DATA) may be either HIGH or LOW (where the data signal does not change during the period t3). The operations in these periods are performed as follows.

In the period t1, the first latch signal (LAT1) at LOW potential turns OFF the third N-type TFT 105. Then, the second P-type TFT 103 is turned ON. On the other hand, The first inverse latch signal (LAT1B) at HIGH potential turns OFF the third P-type TFT 106. Then, the second N-type TFT 104 is turned ON. Therefore, the potential of the gate electrode of the first P-type TFT 101 becomes VDD. Then, the first P-type TFT 101 is turned OFF. At the same time, the potential of the gate electrode of the first N-type TFT 102 becomes VSS. The first N-type TFT 102 is also turned OFF. Then, the data reading circuit enters into the high-impedance state. Therefore, even when a data signal (DATA) changes during the period t1, the change does not affect on the output of the output terminal (OUTPUT).

In the period t2, the first latch signal (LAT1) at HIGH potential turns ON the third N-type TFT 105. Then, The first inverse latch signal at the LOW potential turns ON the third P-type TFT 106. At the same time, the second P-type TFT 103 and the second N-type TFT 104 are turned OFF. However, the second latch signal (LAT2) at LOW potential turns OFF the fourth N-type TFT 301. The second inverse latch signal (LAT2B) at HIGH potential turns OFF the fourth P-type TFT 302. Therefore, in the period t2, the potential of the gate electrode of the first P-type TFT 101 is still VDD. The potential of the gate electrode of the first N-type TFT 102 is VSS. Thus, both of the first P-type TFT 101 and the first N-type TFT 102 are OFF. Therefore, the data reading circuit enters into the high-impedance state. As a result, even when a data signal (DATA) changes during the period t2, the change does not affect on the output of the output terminal (OUTPUT).

In the period t3, the first latch signal (LAT1) at HIGH potential and the first inverse latch signal (LAT1B) at LOW potential turn OFF the second P-type TFT 103 and the second N-type TFT 104. Here, the data signal (DATA) at HIGH potential turns ON the fourth P-type TFT 302, the third P-type TFT 106 and the first N-type TFT 102. When an absolute value of a threshold value of at least one of the fourth N-type TFT 301, the third N-type TFT 105 and first P-type TFT 101 is larger than 3 V, the first P-type TFT 101 is turned OFF. As a result, the output (OUTPUT) becomes VSS potential.

On the other hand, the data signal (DATA) at LOW potential turns ON the fourth N-type TFT 301, the third N-type TFT 105 and the first P-type TFT 101. When an absolute value of a threshold value of at least one of the fourth P-type TFT 302, the third P-type TFT 106 and the first N-type TFT 102 is larger than 3 V, the first N-type TFT 102 is turned OFF. As a result, the output (OUTPUT) becomes VDD potential. Therefore, power consumption can be reduced without leak current.

An operation will be described below in the period t3 where the absolute value of the threshold value is not larger than 3 V (for example, when the threshold value of the P-type TFT is −2 V and when the threshold value of the N-type TFT is 2 V).

When a data signal (DATA) is HIGH, the first N-type TFT 102 is turned ON. The first P-type TFT 101 are also turned ON without entering into the OFF region operation. A difference between the gate-source voltage of the first P-type TFT 101 and the threshold value is −1 V. A difference between the gate-source voltage of the first N-type TFT 102 and the threshold value is 4 V. Generally, a current ability of a TFT can be calculated from the mobility and size of the TFT. In this case, the current ability of the P-type TFT and the current ability of the N-type TFT are designed so as to be substantially equal. Here, the first N-type TFT 102 has a larger absolute value of the difference between the gate-source voltage and the threshold value. Therefore, the effective resistance of the first N-type TFT 102 is lower than that of the first P-type TFT 101. As a result, LOW potential is output from the output terminal (OUTPUT).

On the other hand, when a data signal (DATA) is LOW, the first P-type TFT 101 is turned ON. The first N-type TFT 102 is also turned ON without entering into the OFF region operation. A difference between the gate-source voltage of the first P-type TFT 101 and the threshold value is −4 V. A difference between the gate-source voltage of the first N-type TFT 102 and the threshold value is 1 V. Therefore, the effective resistance of the first P-type TFT 101 having a larger absolute value of the difference between the gate-source value and the threshold value is lower than that of the first N-type TFT 102. As a result, the HIGH potential is output from the output terminal (OUTPUT).

In the period t4 , the first latch signal (LAT1) becomes LOW potential and turns OFF the third N-type TFT 105. The first inverse latch signal (LAT1B) becomes HIGH and also turns OFF the third P-type TFT 106. On the other hand, the second P-type TFT 103 and the second N-type TFT 104 are turned ON. Therefore, the potential of the gate electrode of the first P-type TFT 101 becomes VDD. Then, the first P-type TFT 101 is turned OFF. The potential of the gate electrode of the first N-type TFT 102 becomes VSS and is turned OFF. Then, the data reading circuit enters into the high-impedance state. Therefore, even when a data signal (DATA) changes during the period t4 , the change does not affect on the output of the output terminal (OUTPUT).

In this way, an active output is performed in accordance with the input data signal (DATA) in the period t3. The outputs are in high impedance in the other periods.

The second latch signal (LAT2) and the second inverse latch signal (LAT2B) may be generated by a pulse generator newly. Alternatively, the first latch signal (LAT1) and the first inverse latch signal (LAT1B) may be delayed by a delay circuit, for example. Especially, the latter case is preferable because a pulse generator is not necessary and can be implemented by using an easy device.

Figure 3D:
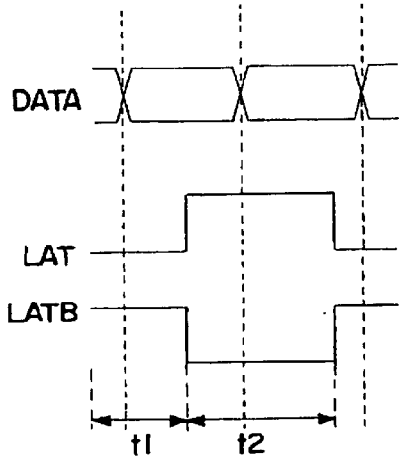
Figure 3B:
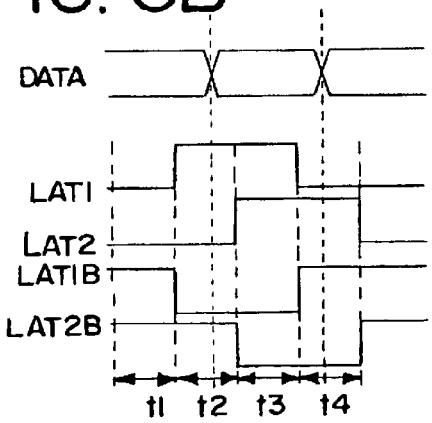
Figure 3E:
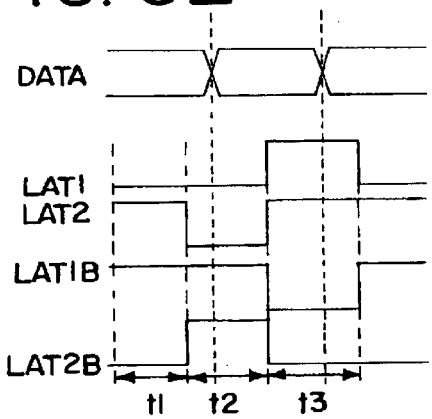
Figure 3C:
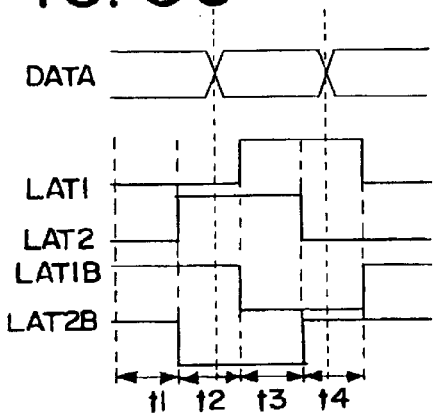

Following is a case where the first latch signal (LAT1) and the second latch signal (LAT2) and the first inverse latch signal (LAT1B) and the second inverse latch signal (LAT2B) are switched and are input in accordance with a timing chart in FIG. 3C. Also in this case, in the period t3, an output is performed in accordance with the data signal (DATA). In the other periods, the data signal (DATA) does not affect on the output. Therefore, the order of the pulse timing of the first latch signal (LAT1) and the second latch signal (LAT2) does not matter.

Like the first embodiment, according to this embodiment, the TFT can operate with a threshold value, which is not valid in the conventional example. Therefore, the response speed can be improved. In this embodiment, no changes in data signal (DATA) are operationally preferable during the period t3.

Fourth Embodiment

Figure 6:
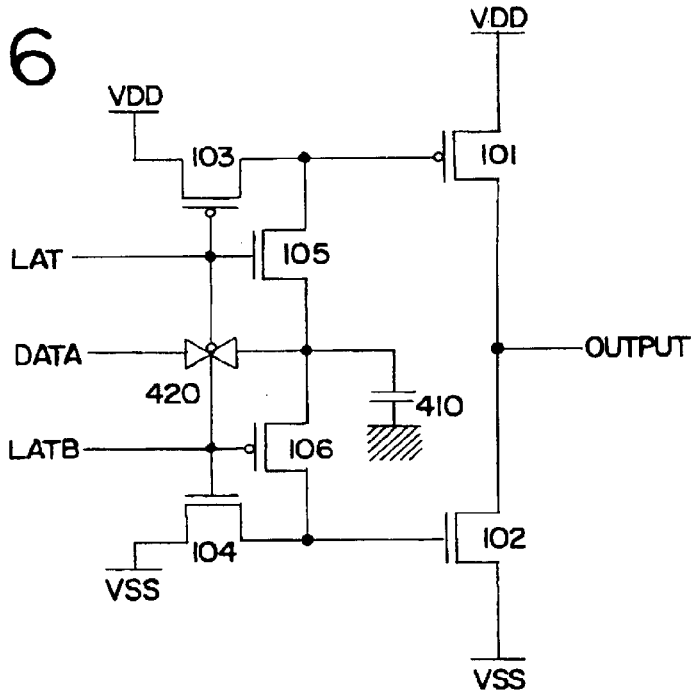
FIG. 6 is a diagram showing an embodiment of the invention.

FIG. 6 shows a construction example of a data reading circuit according to a fourth embodiment of the invention. The data reading circuit according to this embodiment is different from those of the first to third embodiment in that a capacitance 410 and an analog switch 420 are added newly to the data reading-circuit according to the first embodiment. The analog switch 420 controls the inputs of data signals (DATA) to the third N-type TFT 105 and the third P-type TFT 106. A latch signal (LAT) and an inverse latch signal (LATB) are input to the analog switch 420. The analog switch 420, one of the source electrode and drain electrode of the third N-type TFT 105 and one of the source electrode and drain electrode of the third P-type TFT 106 are connected to the capacitance 410. The capacitance 410 integrates charges in accordance with the potential of an input data signal (DATA).

Next, the operation will be described. A data signal (DATA), a latch signal (LAT) and an inverse latch signal (LATB) are input in accordance with a timing chart as shown in FIG. 3D. In a period t1, the latch signal (LAT) is LOW, and the inverse latch signal (LATB) is HIGH. In a period t2, the latch signal (LAT) is HIGH, and the inverse latch signal (LATB) is LOW. The data signal (DATA) may be either HIGH or LOW. The operations in these periods will be described below.

In the period t1, the latch signal (LAT) at LOW potential and the inverse latch signal (LATB) at HIGH potential turn ON the analog switch 420. Thus, charges corresponding to the data signal are integrated in the capacitance 410. The latch signal (LAT) at LOW potential turns OFF the third N-type TFT 105. Then, the second P-type TFT 103 is turns ON. The potential of the gate electrode of the first P-type TFT 101 becomes VDD. Thus, the first P-type TFT 101 is turned OFF. At the same time, the inverse latch signal (LATB) at HIGH potential turns OFF the third P-type TFT 106. Then, the second N-type TFT 104 is turned ON. The potential of the gate electrode of the first N-type TFT 102 becomes VSS. Then, the first N-type TFT 102 is also turned OFF. The data reading circuit enters into the high impedance state. Therefore, even when a data signal (DATA) changes in the period t1, the output from the output terminal (OUTPUT) is not affected.

In the period t2, the latch signal (LAT) at HIGH potential and the inverse latch signal (LATB) at LOW potential turn OFF the analog switch 420, the second P-type TFT 103 and the second N-type TFT 104. The third N-type TFT 105 and the third P-type TFT 106 are turned ON. Charges in accordance with the potential of the data signal (DATA) when the operational period changes from the period t1to the period t2 are integrated in the capacitance 410. Therefore, the charges integrated in the capacitance 410 are input to the gate electrode of the first P-type TFT 101 and the gate electrode of the first N-type TFT 102. Here, the potential changes may occur (when the data signal (DATA) is HIGH, the potential drops, and, when the data signal (DATA) is LOW, the potential rises). This is because of the movement of the charges from the capacitance 410 to the gate electrode of the first P-type TFT 101 and to the gate electrode of the first N-type TFT 102. However, the potential change affects on the ratio between the capacity of the capacitance 410 and the capacity generated by the first P-type TFT 101 and the first N-type TFT 102. Therefore, the potential change can be suppressed when the capacitance 410 can have sufficiently large capacity. As a result, the potential of the gate electrode of the first P-type TFT 101 and the potential of the gate electrode of the first N-type TFT 102 become substantially equal to the potential of the data signal (DATA) in the transition from the period t1to the period t2.

Even when the potential of the data signal (DATA) changes from HIGH to LOW (or from LOW to HIGH) in this period, the analog switch 420 is OFF. Therefore, the output of the output terminal (OUTPUT) is not affected.

Like the first embodiment, according to this embodiment, the TFT can operate with a threshold value, which is not valid in the conventional example. Furthermore, when the latch signal (LAT) is HIGH and the inverse latch signal (LATB) is LOW and when potential of the data signal (DATA) is applied to the gate electrode of the first P-type TFT 101 and to the gate electrode of the first N-type TFT 102, the data signal is shut by the analog switch 420. Therefore, the data signal change in the middle does not affect on the operation.

The capacitance 410 used in this embodiment may be a capacitance using capacity between the gate electrode and input electrode of a TFT or capacity between the gate electrode and output electrode of a TFT. Alternatively, the capacitance 410 may include two materials among a material for a semiconductor layer, a material for a gate electrode and a wire material and an insulating film between the two materials.

In order to reduce the load on the entire data signal line, a device, such as a switch, may be provided between the input terminal and data signal (DATA) inputting portion of the analog switch 420, for selecting a period of capturing a data signal (DATA) into the capacitance 410.

Fifth Embodiment

Figure 7:
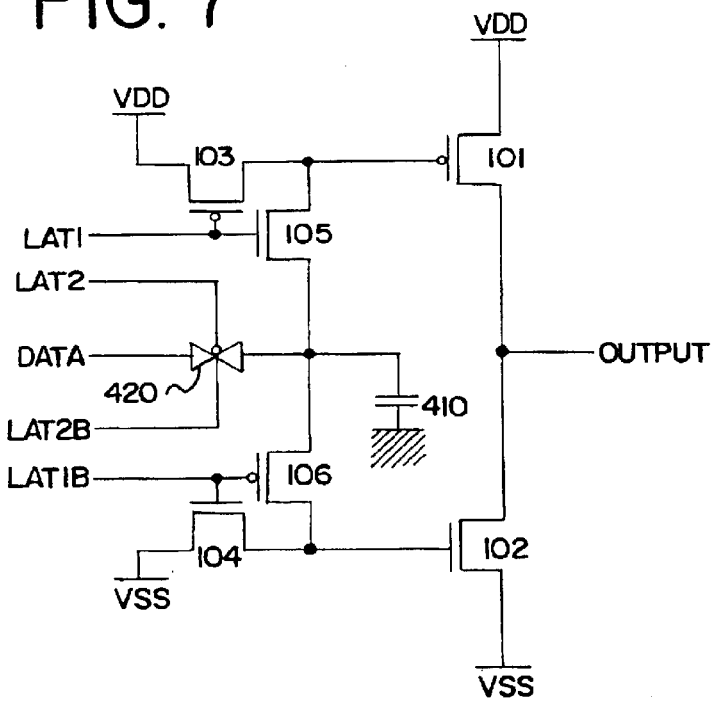
FIG. 7 is a diagram showing an embodiment of the invention.

FIG. 7 shows a construction example of a data reading circuit according to a fifth embodiment. A data reading circuit according to this embodiment is different from the embodiments 1 to 4 in that the latch signal and inverse latch signal for controlling the second P-type TFT 103, the second N-type TFT 104, the third N-type TFT 105, the third P-type TFT 106 and the analog switch 420 in the fourth embodiment are further divided for TFT control (LAT1 and LAT1B) and for analog switch control (LAT2 and LAT2B). The second latch signal (LAT2) and the second inverse latch signal (LAT2B) are input to the analog switch 420. The second inverse latch signal (LAT2B) is an inverse signal of the second latch signal (LAT2).

Next, the operation will be described. A data signal (DATA), a first latch signal (LAT1), a first inverse latch signal (LAT1B), a second latch signal (LAT2) and a second inverse latch signal (LAT2B) are input in accordance with the timing chart shown in FIG. 3E. The second latch signal (LAT2) has a different phase from that of the first latch signal in the same period. In a period t1, the first latch signal (LAT1) is LOW. The second latch signal (LAT2) is HIGH. The first inverse latch signal (LAT1B) is HIGH. The second inverse latch signal (LAT2B) is LOW. In a period t2, the first latch signal (LAT1) is LOW and the second latch signal (LAT2) is LOW. The first inverse latch signal (LAT1B) is HIGH and the second inverse latch signal (LAT2B) is HIGH. In a period t3, the first latch signal (LAT1) is HIGH and the second latch signal (LAT2) is HIGH. The first inverse latch signal (LAT1B) is LOW and the second inverse latch signal (LAT2B) is LOW. The data signal (DATA) may be either HIGH or LOW. The operations in these periods are performed as follows.

In the period t1, the second latch signal (LAT2) at HIGH potential and the second inverse latch signal (LAT2B) at LOW potential turn OFF the analog switch 420. The first latch signal (LAT1) at LOW potential turns OFF the third N-type TFT 105 and turns ON the second P-type TFT 103. The potential of the gate electrode of the first P-type TFT 101 becomes VDD. Thus, the first P-type TFT 101 is turned OFF. At the same time, the first inverse latch signal (LAT1B) at HIGH potential turns OFF the third P-type TFT 106. Then, the second N-type TFT 104 is turned ON. The potential of the gate electrode of the first N-type TFT 102 becomes VSS. Then, the first N-type TFT 102 is also turned OFF. The data reading circuit enters into the high impedance state. Therefore, even when a data signal (DATA) changes in the period t1, the output from the output terminal (OUTPUT) is not affected.

In the period t2, the second latch signal (LAT2) at LOW potential and the second inverse latch signal (LAT2B) at HIGH potential turn ON the analog switch 420. Thus, charges in accordance with the potential of the data signal (DATA) are integrated in the capacitance 410. Here, the first latch signal (LAT1) at LOW potential turns ON the second P-type TFT 103. The potential of the gate electrode of the first P-type TFT 101 becomes VDD. As a result, the first P-type TFT 101 is turned OFF. At the same time, the first inverse latch signal (LAT1B) at HIGH potential turns ON the second N-type TFT 104. The potential of the gate electrode of the first N-type TFT 102 becomes VSS. As a result, the first N-type TFT 102 is turned OFF. Therefore, the data reading circuit enters into the high impedance state. Changes in data signal (DATA) in the period t2 do not affect on the output from the output terminal (OUTPUT).

In the period t3, the second latch signal (LAT2) at HIGH potential and the second inverse latch signal (LAT2B) at LOW potential turn OFF the analog switch 420. The first latch signal (LAT1) at HIGH potential turns OFF the second P-type TFT 103. The first inverse latch signal (LAT1) at LOW potential turns OFF the second N-type TFT 104. Therefore, HIGH or LOW of the data signal (DATA) can be determined based on charges captured into the capacitance 410 in the period t2 independently from the changes in data signal (DATA) in the period t3 to be output from the output terminal (OUTPUT).

According to this embodiment, TFT can operate with a threshold value, which is not valid in the conventional example.

Examples of the invention will be described below.

EXAMPLE 1

A latch circuit using a data reading circuit according to the embodiment will be described in this example.

Figure 8:
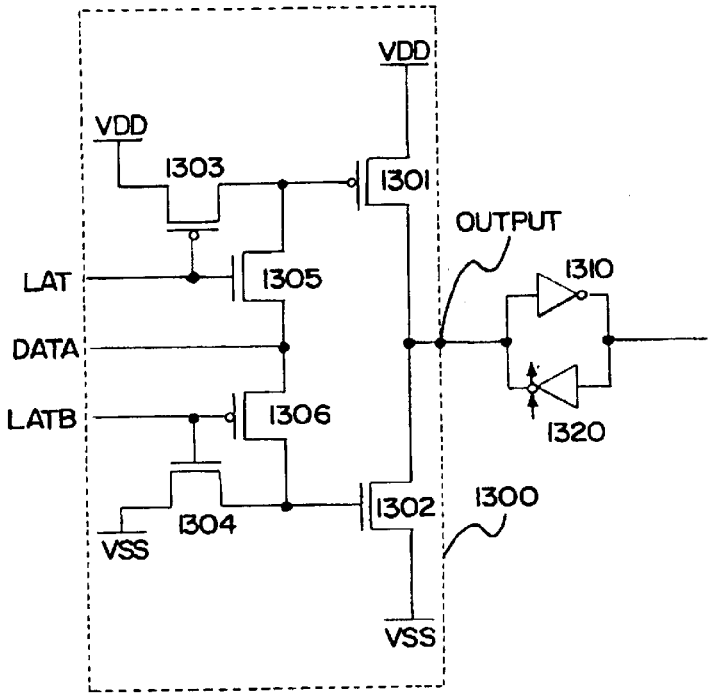
FIG. 8 is a diagram showing a construction of a latch circuit, which is an example of the invention.

FIG. 8 shows a circuit construction of this example. This circuit includes a data reading circuit 1300, an inverter 1310 and a clocked inverter 1320. The data reading circuit 1300 has six transistors including first, second and third P-type TFT's 1301, 1303 and 1306 and first, second and third N-type TFT's 1302, 1304 and 1305. One of a drain electrode of the second P-type TFT 1303, and source and drain electrodes of the third N-type TFT 1305 is connected to a gate electrode of the first P-type TFT 1301. A high potential power supply (VDD) is connected to a source electrode of the first P-type TFT 1301. An output terminal (OUTPUT) of the data reading circuit 1300 is connected to a drain electrode of the first P-type TFT 1301. One of a drain electrode of the second N-type TFT 1304 and source and drain electrodes of the third P-type TFT 1306 is connected to the gate electrode of the first N-type TFT 1302. A low potential power supply (VSS) is connected to a source electrode of the first N-type TFT 1302. The output terminal (OUTPUT) of the data reading circuit 1300 is connected to the drain electrode of the first N-type TFT 1302.

A latch signal (LAT) is input to the gate electrode of the second P-type TFT 1303 and the gate electrode of the third N-type TFT 1305. The high potential power supply (VDD) is connected to the source electrode of the second P-type TFT 1303. A data signal (DATA) is input to one of the source electrode and drain electrode of the third N-type TFT 1305. An inverse latch signal (LATB) is input to the gate electrode of the second N-type TFT 1304 and the gate electrode of the third P-type TFT 1306. The low potential power supply (VSS) is connected to the source electrode of the second N-type TFT 1304. A data signal (DATA) is input to the other of the source electrode and drain electrode of the third P-type TFT 1306.

An input electrode of the inverter 1310 is connected to the output terminal (OUTPUT) of the data reading circuit 1300. An input terminal of the clocked inverter 1320 is connected to the output terminal of the inverter 1310. The output terminal of the reading circuit 1300 is connected to the output of the clocked inverter 1320. The clocked inverter controls by using a latch signal and an inverse latch signal (not shown).

For example, the circuit in FIG. 8 may operate at VSS of 0 V, VDD of 9 V, and LOW and HIGH potentials of data signals (DATA) of 3 V and 6 V, respectively. Also, same as power supply potential, HIGH and LOW potentials of the latch signal (LAT) and the inverse latch signal (LATB) are 0 V and 9 V, respectively. The threshold values of all of the N-type TFT's are 2 V. The threshold values of the P-type TFT's are −2 V. In this example, the reading circuit 1300 is the same as the circuit according to the first embodiment. Therefore, the data signal (DATA), the latch signal (LAT) and the inverse latch signal (LATB) are input in accordance with the time chart in FIG. 3A like the first embodiment. In a period t1, the latch signal (LAT) is HIGH and the inverse latch signal (LATB) is LOW. In a period t2, the latch signal (LAT) is LOW and the inverse latch signal (LATB) is HIGH. The data signal (DATA) may be either HIGH or LOW (where the data signal does not change in the period t1). Operations in these periods will be described below.

In the period t1, the data signal (DATA) at HIGH potential turns ON the first N-type TFT 1302. However, the first P-type TFT 1301 is also turned ON without entering into the OFF region operation. A difference between the gate-source voltage of the first P-type TFT 1301 and the threshold value is −1 V. A difference between the gate-source voltage of the first N-type TFT 1302 and the threshold value is 4 V. Generally, a current ability is calculated from the mobility and the size of the TFT's. The current abilities of the P-type TFT and N-type TFT are designed substantially equal. In this case, the N-type TFT 1302 has a larger absolute value of the difference between the gate-source voltage and the threshold value. Therefore, the N-type TFT 1302 has lower effective resistance than that of the P-type TFT 1301. As a result, LOW potential is output from the output terminal (OUTPUT).

On the other hand, the data signal (DATA) at LOW turns ON the first P-type TFT 1301. However, the first N-type TFT 1302 is also turned ON without entering into the OFF region operation. Here, a difference between the gate-source voltage of the first P-type TFT 1301 and the threshold value is −4 V. A difference between the gate-source voltage of the first N-type TFT 1302 and the threshold value is 1 V. In this case, the first P-type TFT 1301 has a larger absolute value of the difference between the gate-source voltage and the threshold value. Therefore, the first P-type TFT 1301 has lower effective resistance than that of the first N-type TFT 1302. As a result, HIGH potential is output from, the output terminal (OUTPUT).

Here, the clocked inverter 1320 is in the high impedance state. Therefore, the output of the clocked inverter 1320 does not conflict with the output of the reading circuit 1300.

In the period t2, the latch signal (LAT) at LOW potential turns OFF the third N-type TFT 1305 and turns ON the second P-type TFT 1303. Therefore, the potential of the gate electrode of the first P-type TFT 1301 becomes VDD. Then, the first P-type TFT 1301 is turned OFF. At the same time, the inverse latch signal (LATB) at HIGH potential turns OFF the third P-type TFT 1306 and turns ON the second N-type TFT 1304. Therefore, the potential of the gate electrode of the first N-type TFT 1302 becomes VSS. Then, the first N-type TFT 1302 is turned OFF. The data reading circuit 1300 enters into the high impedance state. The clocked inverter 1320 functions as an inverter and establishes a loop with the inverter 1310. A video signal captured when the latch signal (LAT) is HIGH is held. Therefore, even when a data signal (DATA) changes in the period t2, the output from the output terminal (OUTPUT) is not affected.

The data reading circuit 1300 is not limited to this example and may be any of the circuits in the first to fifth embodiments. In this example, the inverter 1310 and the clocked inverter 1320 are used for holding data. Instead, two inverters may be used, or a capacitance may be used.

EXAMPLE 2

In this example, the latch circuit used in the first example is used for a source driver. A source driver captures input data signals and outputs analog-converted signals to a source line corresponding to a pixel to be driven.

Figure 9:
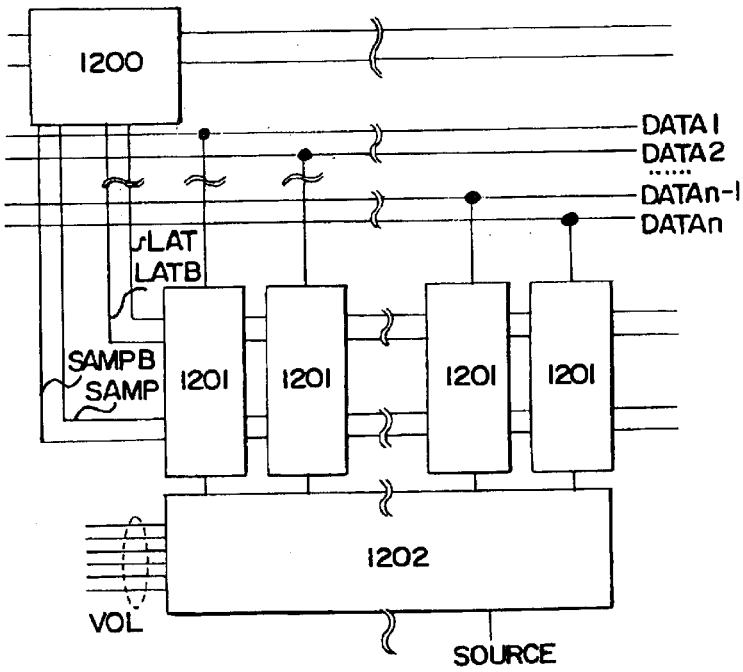
FIG. 9 is a diagram showing a construction of a source driver, which is an example of the invention.

FIG. 9 shows a construction diagram of the source driver. The source driver includes a shift register 1200, a latch circuit 1201, and a DAC 1202. A general source driver further includes a level shifter required for amplifying data signals when a latch circuit is operated. However, the invention eliminates the need for the level shifter. An actual source driver requires source lines equal to the number of rows of pixels. Therefore, the source driver part of a display device has the equal numbers of circuits shown in FIG. 9 to the number of rows.

The operation will be described. A latch signal (LAT) and an inverse latch signal (LATB) are sent from the shift register 1200 and are input to the latch circuit 1201. The latch circuit 1201 holds and outputs to the DAC the data signal (DATA), the latch signal (LAT), the inverse latch signal (LATB), a sampling signal (SAMP) and a data signal (DATA). The sampling signal (SAMP) controls the clocked inverter within the latch circuit. The data signal (DATA) is input in response to an inverse sampling signal (SAMPB). The DAC selects one of multiple power supply level line (VOL) in accordance with the outputs from the multiple latch circuits. Alternatively, the DAC selects two power supply level line and selects a voltage within a voltage range. Then, the DAC outputs the selected source line (Source).

The latch circuit may be a circuit used in the first example. The shift register includes multiple inverters and clocked inverters. The shift register shifts and outputs input signals by one cycle or half cycle. The shift register may be a publicly known one. The DAC converts digital signals to analog signals. Various forms of DAC exist with various constructions. However the DAC may be a publicly known one like the shift register. An analog buffer may be provided after the DAC. The sampling signal and the inverse sampling signal may be a latch signal and an inverse latch signal.

In this example, digitally input signals are analog-output. However, apparently, the digitally input signals may be digitally output.

EXAMPLE 3

Examples of electronic devices to which the present invention is applied include a video camera, a digital camera, a goggle type display (head-mounted display), a navigation system, a sound reproducing system (car audio system, audio component stereo, or the like), a lap-top computer, a game player, a portable information terminal (mobile computer, cell phone, portable game player, electronic book, or the like), and an image reproducing system provided with a recording medium (specifically, device which plays a recording medium such as a Digital Versatile Disc (DVD) and is provided with a display for displaying images). Specific examples of the electronic devices are shown in FIGS. 10A to 10G.

Figure 10A:
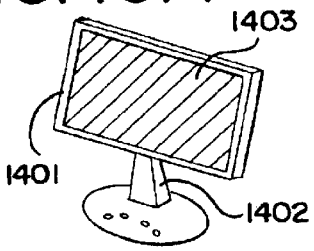
FIGS. 10A to 10G are diagrams showing examples of an electronic apparatus to which the present invention can apply.

FIG. 10A shows a liquid crystal display or an EL display, which includes a casing 1401, a support stand 1402, and a display portion 1403. The present invention can be applied to the driving circuit of the display apparatus having the display portion 1403.

Figure 10B:
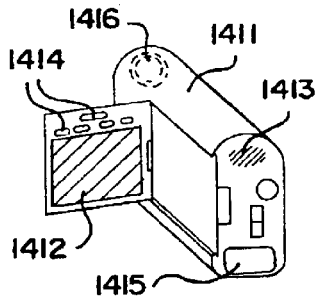

FIG. 10B shows a video camera, which is constituted by a main body 1411, a display portion 1412, a sound input portion 1413, operation switches 1414, operation switches 1415, a battery 1416, an image receiving portion 1417, and the like. The present invention can be applied to the driving circuit of the display apparatus having the display portion 1417.

Figure 10C:
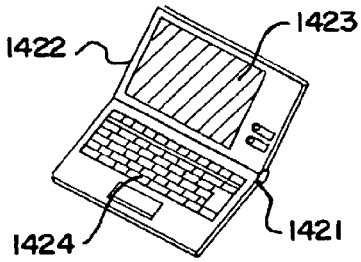

FIG. 10C shows a lap-top computer, which is constituted by a main body 1421, a casing 1422, a display portion 1423, a keyboard 1424, and the like. The present invention can be applied to the driving circuit of the display apparatus having the display portion 1423.

Figure 10D:
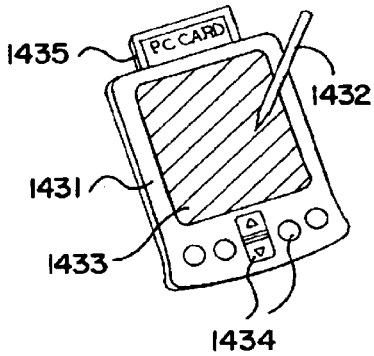

FIG. 10D shows a portable information terminal, which is constituted by a main body 1431, a display portion 1432, switch buttons 1433, an external interface 1434 and the like. The present invention can be applied to the driving circuit of the display apparatus having the display portion 1432.

Figure 10E:
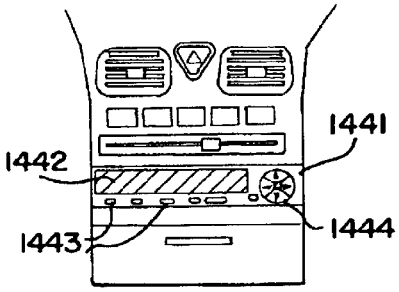

FIG. 10E shows a sound reproducing system, specifically, an audio system for an automobile, which is constituted by a main body 1441, a display portion 1442, operation switches 1443 and 1444, and the like. The present invention can be applied to the driving circuit of the display apparatus having the display portion 1442. Further, the audio system for an automobile is taken as an example here, but a portable or domestic audio system may be given.

Figure 10F:
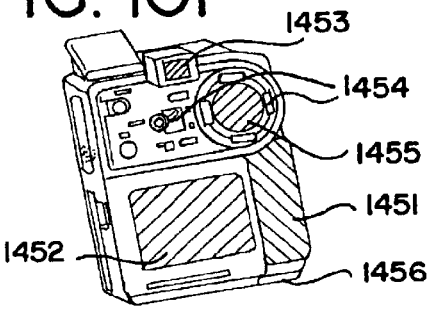

FIG. 10F shows a digital camera, which is constituted by a main body 1451, a display portion A 1452, an eyepiece portion 1453, operation switches 1454, a display portion B 1455, a battery 1456, and the like. The present invention can be applied to the driving circuit of the display apparatus having the display portion A 1452 and the display portion B 1455.

Figure 10G:
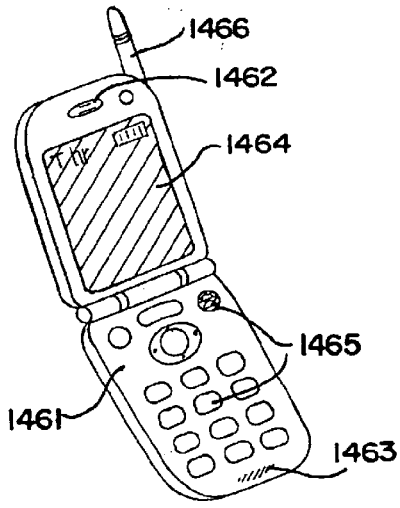
Figure 11:
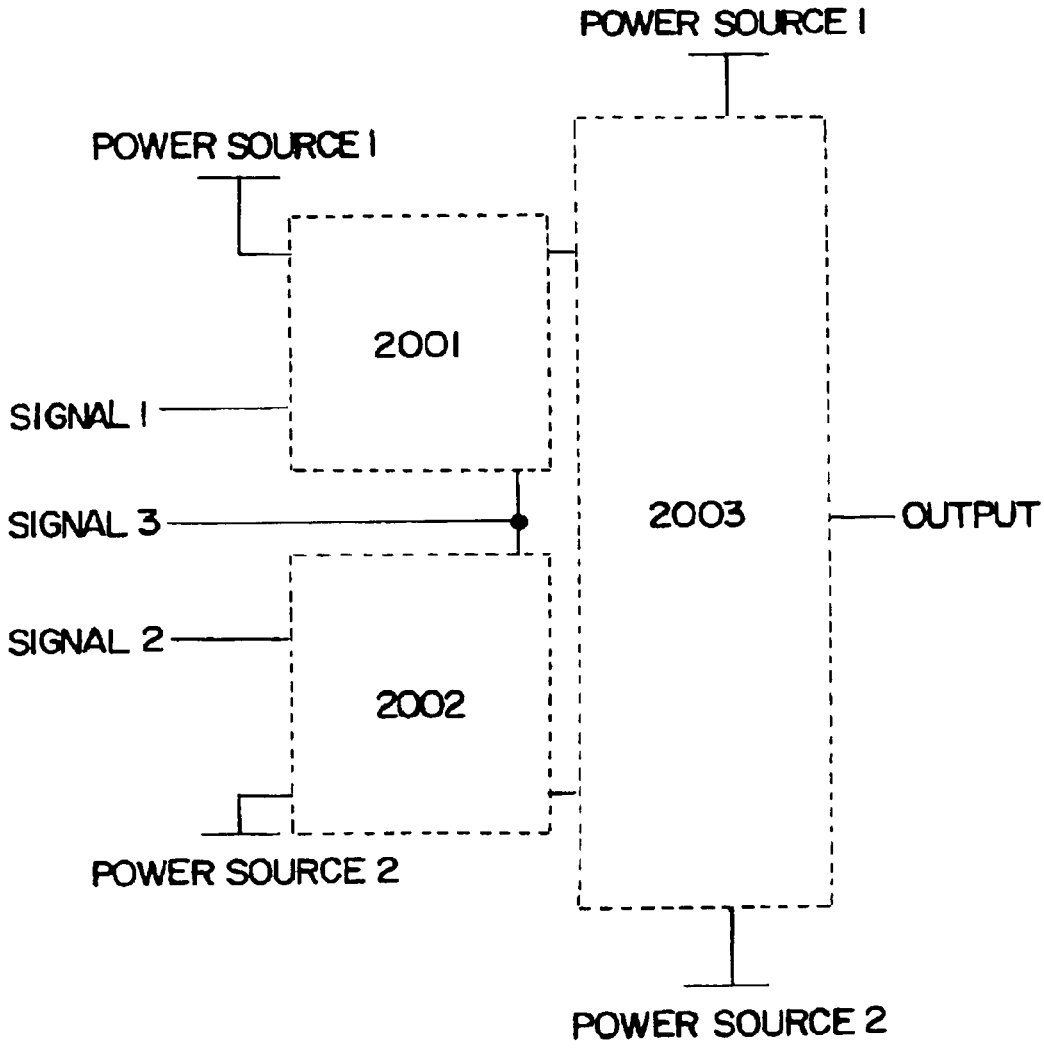
FIG. 11 is a diagram schematically showing the invention.

FIG. 10G shows a cell phone, which is constituted by a main body 1461, a sound output portion 1462, a sound input portion 1463, a display portion, 1464, operation switches 1465, an antenna 1466, and the like. The present invention can be applied to the driving circuit of the display apparatus having the display portion 1464.

Not only a glass substrate but also a heat-resistance plastic substrate can be used for the display apparatus used in each of the above electronics. Thus, reduction in weight of the electronics can be attained.

Note that examples shown in Example 3 are no more than some application examples. It should be mentioned that the present invention is not limited to these uses.

Example 3 can be performed by freely combining with Embodiments 1 to 5 and Examples 1 to 2.

According to the invention, a level shifter is not required, and the number of level shift IC's, power supply IC's and parts thereof are reduced outside of the panel. Therefore, the power consumption can be reduced. Inside of the panel, the reduction of the size of layout area, the improvement in yield because of the size reduction, the reduction of power consumption becomes possible. Furthermore, the TFT's can be operated at high frequencies.

According to the invention, a double-gate TFT (two TFT's connected in series) may be replaced by a single-gate TFT. Thus, a TFT gate width does not have to be set large. Furthermore, the TFT size can be reduced. Therefore, larger packing density can be achieved. Additionally, the loads on elements having loads on the gate (gate capacitance) can be reduced. Therefore, the entire load can be reduced. As a result, high frequency operations can be implemented.

Furthermore, the present invention is strong against differences in threshold of TFT's. Even if the signal amplitude is smaller than power supply voltage, signals can be used directly to operate precisely.

What is claimed is:

1. An electric circuit comprising:

an N-type transistor;

a first P-type transistor; and a second P-type transistor, wherein the N-type transistor and the first P-type transistor are connected in series, wherein a gate electrode of the N-type transistor is connected to a gate electrode of the first P-type transistor, wherein a drain electrode of the N-type transistor and a drain electrode of the first P-type transistor are connected to a gate electrode of the second P-type transistor, wherein a source electrode of the first P-type transistor is electrically connected to a power supply, and wherein a source electrode of the N-type transistor is connected to a data signal input portion.

2. An electric circuit according to claim 1, wherein the amplitude of the signal is smaller than that of power supply voltage.

3. An electric circuit according to claim 1, wherein the electric circuit is incorporated into a latch circuit.

4. An electric circuit according to claim 1, wherein the electric circuit is incorporated into an electronic equipment selected from the group consisting of s liquid crystal display, an EL display, a video camera, a lap-top computer, a portable information terminal, a sound reproducing system, a digital camera, and a cell phone.

5. An electric circuit according to claim 1 further comprising a second N-type transistor and a third N-type transistor.

6. An electric circuit according to claim 1 further comprising an analog switch, wherein the analog switch is provided between the source electrode of the N-type transistor and the data signal input portion.

7. An electric circuit, comprising:

a first N-type transistor;

a P-type transistor; and a second N-type transistor, wherein the first N-type transistor and the P-type transistor are connected in series, wherein a gate electrode of the first N-type transistor is connected to a gate electrode of the P-type transistor, wherein a drain electrode of the first N-type transistor and a drain electrode of the P-type transistor are connected to a gate electrode of the second N-type transistor, wherein a source electrode of the first N-type transistor is electrically connected to a power supply, and wherein a source electrode of the P-type transistor is connected to a data signal input portion.

8. An electric circuit according to claim 7, wherein the amplitude of the signal is smaller than that of power supply voltage.

9. An electric circuit according to claim 7, wherein the electric circuit is incorporated into a latch circuit.

10. An electric circuit according to claim 7, wherein the electric circuit is incorporated into an electronic equipment selected from the group consisting of s liquid crystal display, an EL display, a video camera, a lap-top computer, a portable information terminal, a sound reproducing system, a digital camera, and a cell phone.

11. An electric circuit according to claim 7 further comprising a second P-type transistor and a third P-type transistor.

12. An electric circuit according to claim 7 further comprising an analog switch, wherein the analog switch is provided between the source electrode of the P-type transistor and the data signal input portion.

13. A latch circuit comprising:

a first N-type transistor and a first P-type transistor connected in series;

a first compensating circuit for selecting an input of a data signal or an input of a first power supply potential based on an input latch signal and for outputting the selected input to a gate electrode of the first P-type transistor;

a second compensating circuit for selecting an input of a data signal or an input of a second power supply potential based on an input inverse latch signal and for outputting the selected input to a gate electrode of the first N-type transistor, wherein the data signal is input from a same signal line, and wherein the output of the latch circuit is extracted from a connecting portion between the first N-type transistor and the first P-type transistor connecting portion.

14. A latch circuit according to claim 13, wherein the first power supply is connected to the first compensating circuit.

15. A latch circuit according to claim 13, wherein the second power supply is connected to the second compensating circuit.

16. A latch circuit according to claim 13, wherein at least one of the first N-type transistor and the first P-type transistor has a double-gate structure.

17. A latch circuit according to claim 13, wherein at least one of the first N-type transistor and the first P-type transistor has a multi-gate structure.

18. A latch circuit according to claim 13, wherein the latch circuit is incorporated into an electronic equipment selected from the group consisting of s liquid crystal display, an EL display, a video camera, a lap-top computer, a portable information terminal, a sound reproducing system, a digital camera, and a cell phone.

19. A latch circuit comprising:

a circuit having a first P-type transistor and a first N-type transistor, wherein a source electrode of the first P-type transistor is connected to a first power supply and a source electrode of the first N-type transistor is connected to a second power supply;

a first compensating circuit having a second N-type transistor and a second P-type transistor, wherein gate electrodes of the second N-type transistor and second P-type transistor are connected to each other and the second N-type transistor and the second P-type transistor are connected in series;

a second compensating circuit having a third N-type transistor and a third P-type transistor, wherein gate electrodes of the third N-type transistor and third P-type transistor are connected to each other and the third N-type transistor and third P-type transistor are connected in series;

wherein source electrodes of the second N-type transistor and third P-type transistor are connected to a same data line, wherein a source electrode of the second P-type transistor is connected to the first power supply, wherein a source electrode of the third N-type transistor is connected to the second power supply, wherein drain electrodes of the second N-type transistor and second P-type transistor are connected to a gate electrode of the first P-type transistor, wherein drain electrodes of the third N-type transistor and third P-type transistor are connected to a gate electrode of the first N-type transistor, and wherein an output is extracted from a drain electrode of the first N-type transistor or first P-type transistor.

20. A latch circuit according to claim 19, wherein at least one of the first N-type transistor, the first P-type transistor, the second N-type transistor, the second P-type transistor, the third N-type transistor, and the third P-type transistor has a double-gate structure.

21. A latch circuit according to claim 19, wherein at least one of the first N-type transistor, the first P-type transistor, the second N-type transistor, the second P-type transistor, the third N-type transistor, and the third P-type transistor has a multi-gate structure.

22. A latch circuit according to claim 19, wherein the latch circuit is incorporated into a display apparatus.

23. A latch circuit according to claim 19, wherein the latch circuit is incorporated into an electronic equipment selected from the group consisting of s liquid crystal display, an EL display, a video camera, a lap-top computer, a portable information terminal, a sound reproducing system, a digital camera, and a cell phone.

* * * * *